US006195067B1

(12) United States Patent
Gilger

(10) Patent No.: US 6,195,067 B1
(45) Date of Patent: Feb. 27, 2001

(54) REMOTELY ADJUSTABLE MESH DEPLOYABLE REFLECTORS

(75) Inventor: L. Dwight Gilger, Torrance, CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/247,162

(22) Filed: Feb. 9, 1999

(51) Int. Cl.[7] ..... H01Q 15/20
(52) U.S. Cl. ..... 343/915; 343/912
(58) Field of Search ..... 343/915, 912, 343/916, 881, 880, DIG. 2; 52/111; H01Q 15/20

(56) References Cited

U.S. PATENT DOCUMENTS 4,475,323 * 10/1984 Schwartzberg et al. ..... 343/915
5,440,320 * 8/1995 Lach et al. ..... 343/915
5,680,145 10/1997 Thomson et al. ..... 343/915
5,990,850 * 11/1999 Henderson et al. ..... 343/915
6,028,569 * 2/2000 Bassily et al. ..... 343/915
6,028,570 * 2/2000 Gilger et al. ..... 343/915

* cited by examiner

*Primary Examiner*—Hoanganh Le
(74) *Attorney, Agent, or Firm*—Michael S. Yatsko; Ronald M. Goldman

(57) ABSTRACT

The reflective mesh material that forms the reflector in a foldable perimeter truss antenna is remotely adjusted to shape using remotely controlled stepper motors carried on the truss. Connected to the end of the catenaries, which shape and support the pliant reflective mesh material on the truss, the stepper motors adjust the tension on the catenaries and thereby change its shape. An RF receiver and electronic controller associated with each stepper motor receives the tension command information from a remote source and controls the stepper motor in accordance with that information.

11 Claims, 3 Drawing Sheets

REMOTELY ADJUSTABLE MESH DEPLOYABLE REFLECTORS

FIELD OF THE INVENTION

This invention relates to deployable perimeter truss supported reflectors, principally found in high frequency microwave off-set parabolic antennas, and, more particularly, to an improvement for remotely adjusting the profile of the reflective fabric supported in the perimeter truss structure.

BACKGROUND

A parabolic reflector is a constituent element of a microwave frequency off-set parabolic antenna. Taking advantage of the unique property of that dish shaped reflective surface, wherein RF energy incident at any location on the surface is reflected to the parabola's focal point, the antenna's feed component is located at the surface's focal point. As a consequence, the more diffuse essentially spatially displaced RF fields propagating through space are concentrated or focused to a single point, thereby producing a more intense RF field at that point. That advantage permits intelligible reception of weaker RF signals than otherwise could not be detected. For the foregoing reason and other reasons well known to those skilled in the art, the parabolic antenna is widely used in communications systems, including those found in space vehicles.

In space vehicle application those antennas are "deployable". That is, the antenna is constructed of a structure that may be folded up into a package of small volume, suitable for stowage in the limited space available on board a space craft and then be expanded to a much larger size structure, following launch and orbital positioning of that space craft. RF deployable parabolic reflectors in space vehicle application typically employ a reflective fabric, such as a elastic wire mesh or comparable structure, as the reflective surface. The reflective fabric is light weight and pliant in nature, so it may be compacted as part of the stowed package. When the reflector is deployed, the fabric is stretched out by the associated supports to form a parabolic curved surface. An example of such reflectors are found in the patent literature, such as U.S. Pat. No. 5,680,145 granted Oct. 21, 1997 to Thomson et al, assigned to Astro Aerospace Corp.

A more recent deployable antenna is known as a foldable perimeter truss antenna, such as the one described in the '145 patent to Astro. In that type antenna the reflective material is supported upon a truss, a framework of tubes that is formed into a short hollow cylinder. The reflective material covers a circular end of that hollow cylinder and lies there over, vaguely resembling a sagging drum head.

To support and profile the shape of the pliant reflective mesh material, lines, referred to as catenaries, are strung from the periphery of the cylinder across the end and collectively define a skeletal parabolic shape. The reflective material is then tied to those catenaries and assumes the parabolic shape defined by that skeletal structure. The foregoing only generally describes the truss structure and its connection to the supported reflective material. Those less skilled in the art who wish to ascertain additional details of that structure are invited to review the cited patent to Thomson et al. Additional reference may also be made to the novel perimeter truss structure described in the pending application to Gilger and Parker, the present inventors, Ser. No. 09/080,767 filed May 18, 1998 and now U.S. Pat. No. 6,028,570, granted Feb. 22, 2000.

The present improvement relates to the catenaries and the connection of those catenaries to the truss structure and to the resultant effect thereof on the resultant profile of the reflective mesh supported on those catenaries. More particularly, the foregoing reflector structure includes an adjustment scheme to permit factory adjustment of the contour of the mesh.

Essentially a large number of cords or ties attached to the backside of the reflective fabric are used to attach the reflective mesh fabric to the supporting catenaries. The mesh is essentially sewn to each catenary line.

In practice, to form the desired contour or profile in one prior truss structure, two identical sets of catenary lines are used. One set is attached to the front end and the other set on the rear end, with each catenary line in one set being aligned with and overlying a corresponding catenary line in the other set. Each set is formed of a plurality of spaced lines that extend across the circular end of the truss. The lines ends are attached to a structural member along the periphery of the truss, so that each line is supported like a clothes line, and held reasonably taut.

At each intermediate positions along each line, a cord or tie of a precisely determined length for that position is dropped down and tied to the same intermediate position on the underlying catenary line of the second set. The tie pulls one catenary line against the other identical line, pulling the line at the front end down and the line at the rear end up similar to the vertical lines on a suspension bridge. By appropriately adjusting the length of each tie in the series on that one catenary line, the associated catenary line in the two sets are formed to a parabolic shape, forming essentially a section line of an imaginary parabolic surface. By making the same ties and adjustment in the ties of all of the other catenary lines to form section lines at different positions of such an imaginary parabolic surface, the net effect is that the front catenary lines, and the rear ones as well, collectively define a skeletal configuration of the desired parabolic shape.

The reflective metal mesh material is of a generally circular shape at least as large as the circular front end of the truss. It is fastened along its outer edge to a structural support along the periphery of the truss, leaving the central portion of the material to drape. Being somewhat pliant, the central portion of the metal mesh drapes into place onto the catenaries, which serves as its bed, and assumes the parabolic contour or profile defined by those catenaries. The mesh is then sewn to the catenary lines to form a permanent attachment.

The foregoing describes but one arrangement for the catenary lines and the mesh and serves to introduce the general principles underlying the catenary arrangement and the relationship to the latter of the reflective mesh. In another arrangement the reflective material is located beneath the upper catenaries, held taut about its periphery by supports along the periphery of the support, and the catenary drop ties are threaded through the reflective mesh and connected to the corresponding catenary lines on the rear set. In achieving its parabolic contour, the upper catenary lines press against the reflective mesh, and press the mesh into a like contour. There are of course others, such as that presented in the cited Astro patent, and new structures such as presented in the cited pending application of Gilger et al, but the general principles of the catenaries are common to all.

In the described way, the contour of the surface is adjusted to the desired geometric shape. The foregoing is a hand adjustment. The more precision in shape an antenna requires, the greater the number of catenaries and/or drop ties used, and, thus, the greater then is the number of adjustments needed to attain the desired accuracy. Typically, the number of ties that must be adjusted numbers in the hundreds.

As one appreciates, assembly and adjustment of the ties is tedious, time consuming and difficult, unlike the ease with which review of the foregoing text was made. The fabric and ties are physically delicate in nature. Contributing to the difficulty of the manual adjustment is the risk that the technician may inadvertently damage the reflector. Hence, the technician must be extra cautious in performing the large number of adjustment operations required. That caution is translated into slowness of production. And should damage occur, the assembly must be repaired, which is time consuming, or be entirely abandoned and construction started over. Moreover, the completion of a perfectly shaped reflector at the factory is not an end to the problem. The reflector must be delivered and deployed.

Moving from a successful adjustment at the factory to deployment in outer space introduces many additional parameters that may adversely affect the factory adjustments, a change in gravitational force, as example, and thereby change the accuracy of the reflective surface's profile. No existing means is known to adjust the surface's contour once the reflector has been deployed in outer space. And with a less than ideal profile for the reflective surface, the parabolic antenna's RF gain is reduced from the optimum level, lowering performance.

Accordingly, an object of the invention is to provide a hands-free adjustment scheme for adjusting the contour or profile of a pliable reflective surface.

A further object of the present invention is to enhance the efficiency with which a deployable reflector may be manufactured.

A still further object is to improve the contour adjustment procedures for a foldable perimeter truss reflector antenna.

An additional object of the invention is to permit remote control of the profile adjustment of a deployable offset or symmetrical parabolic antenna's reflector, allowing the contour to be adjusted or refocused even after deployment in outer space.

SUMMARY OF THE INVENTION

The present invention achieves the first known means to hands-free adjust the contour of the reflective mesh surface of a deployable reflector, allowing adjustments to the surface contour to be commanded remotely, even while the reflector is deployed in outer space. An improved foldable perimeter truss reflector in accordance with the invention includes electric tensioning means, for controlled hands-free tensioning of the catenary lines, suitably a microminiature stepper motor. The tensioning means includes a digital electronic controller that receives command information from a remote source to control operation of the stepper motor. In accordance with an additional feature, electrical power is supplied by a rechargeable source supplied by a photoelectric cell, permitting the tensioning means to be self-sufficient.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DESCRIPTION OF THE PREFERRED EMBODIMENTS

Although the improvement can be described in connection with any of the prior trusses presented in the foregoing background, the improvement is most conveniently and best described as an addition to the novel folding perimeter truss structure presented in the cited pending application for patent to Gilger and Parker, Ser. No. 09/080,767 filed May 18, 1998, now U.S. Pat. No. 6,028,570, and to the improved perimeter truss structure obtained by incorporating the modifications herein described. It should be emphasized, however, that any truss antenna that employs a catenary system may be modified to incorporate the improvement.

Figure 1:
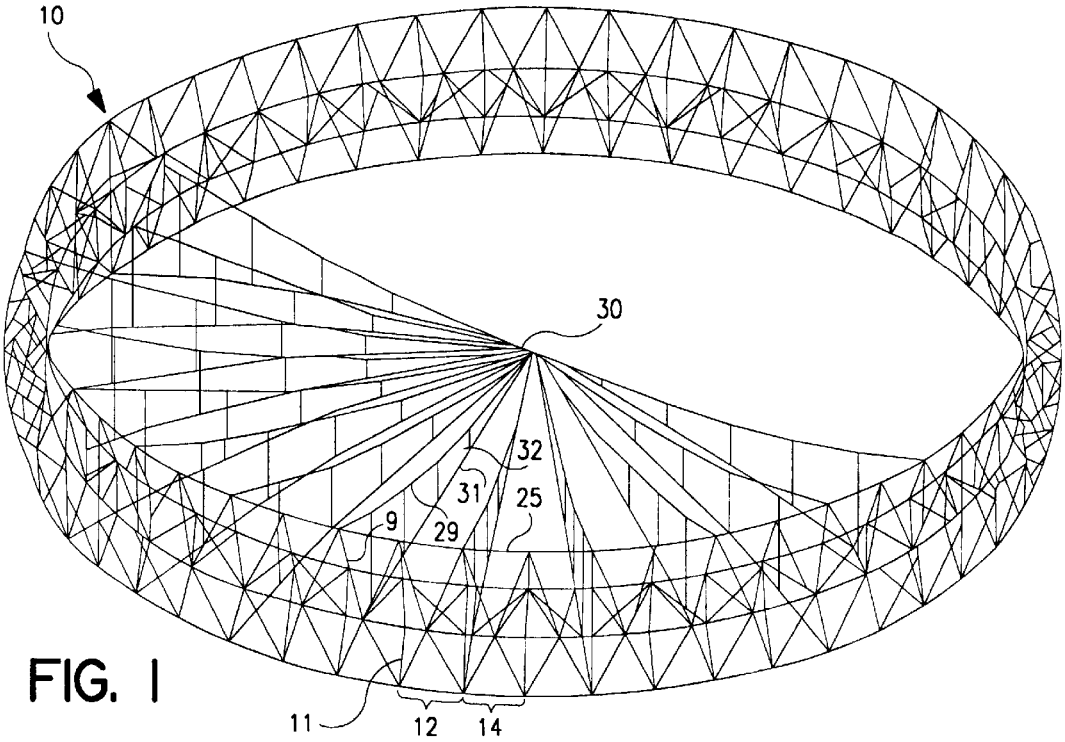
FIG. 1 is a partial perspective view of an improved perimeter truss made in accordance with the present invention, illustrating half of the catenary system that supports and shapes the antenna reflector.
Figure 2:
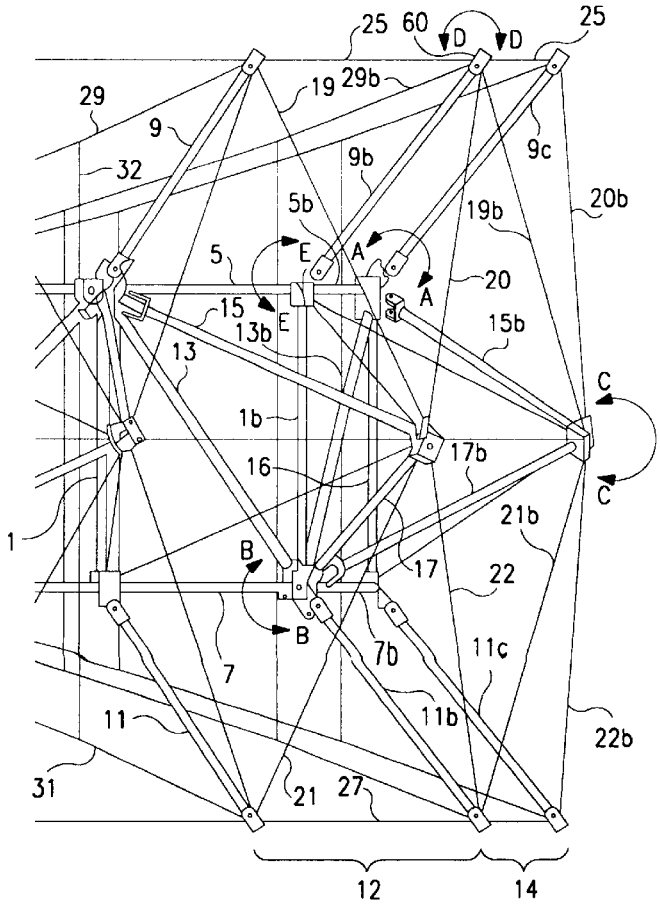
FIG. 2 is a partial perspective view of two and a half bay portion of the perimeter truss of FIG. 1, drawn to a larger scale, showing the connection of the spars to the catenaries.

Reference is made to FIG. 1 partially diagrammatically illustrating a foldable perimeter truss structure, as deployed, which contains the invention. More specifically, the adjusting devices, not visible in this figure, are incorporated within the structure of a new foldable perimeter truss reflector design, which is the subject of the previously cited copending application for patent to Gilger and Parker, the contents of which are incorporated herewithin by reference. As those skilled in the art recognize, the illustrated truss structure contains a new catenary system, different from that described in the foregoing background, a feature of the cited novel truss. Brief reference may be made to FIG. 2 illustrating pictorially, to a larger scale, a portion of that truss in greater detail, evidencing the complex relationship of the structural members.

The following description identifies elements of the prior truss, but does not repeat the description of its operation or function relating to folding and/or unfolding, except as may be incidental to the description of the present improvement. It is assumed that the reader is sufficiently knowledgeable in the nomenclature used for structural elements to the perimeter truss and in the function of those elements or which should be evident to those skilled in the art. Those less skilled who are interested in additional details may make reference to the cited Gilger and Parker application.

In the following description, reference is often made to a connection between an end of one structural member of the prior perimeter truss and that of another member, whether it be a pivotal connection, or a fixed connection. It should be understood, however, that the term "connection" is being used in a general sense to minimize description of structural detail that is unnecessary to the description at that point in the text. With that foundation, The less skilled reader should thus be able to more quickly understand the present improvement. However, in practice and in the described embodiment, such a connection between two or more structural elements is not a direct one, but an indirect one, that is made through a separate joint coupling, referred to as a "fitting". Thus, all such connections for the perimeter truss described are accomplished with fittings.

Further, as those skilled in the art recognize, the fittings differ from one another in detail depending upon its location within the truss and the number and kind of structural members terminated at that location, as becomes apparent from the various joints presented in this description. However, while structural details of those fittings may be material to the description of the prior truss structures, with one exception, those details are not necessary to an understanding of the present invention, which improves upon the prior truss structure, and need not be repeated in the present text. The one exception, which the reader will recognize from the description of the drawings that follows in this application, is a single fitting that incorporates the additional structure defined by the present improvement. Those wishing to learn additional details of the fittings for the perimeter truss presented herein as the foundation to the present improvement invention may make reference to the cited Gilger and Parker application, earlier herein cited, which is incorporated herein by reference.

A foldable perimeter truss structure 10 is partially illustrated in the deployed condition in a top perspective view in line drawing in FIG. 1 to which reference is made. Here the fully deployed foldable perimeter truss 10 is viewed in perspective from the top front end. The side of the truss is characterized by multiple compartments of identical structure, referred to as bays, formed by the structural members. Two of the bays 12 and 14 forming the truss are labeled in the figure, as well as upper and lower deployable spars 9 and 11, respectfully, located at the left end of bay 12. The top end of the truss formed by a hoop line 25 is a single edge, defining a wide circle, and the bottom end is similarly formed to an edge defined by a rear hoop line 27, while the entire truss framework defines skeletally a short hollow cylinder.

The catenary line system includes the upper catenary lines, only one of which is labeled 29, and the lower catenary lines 31, radially aligned with the former lines, both of which are inextensible tension members. It should be noted that only one-half of the catenaries are illustrated in the figure, those filling the semi-circular portion of the circular end of the truss. The others are omitted for clarity. All of the catenary lines 29 and 31 radiate radially outward from the center of the truss. They essentially form a pair of nets, the upper one for supporting the reflective mesh material forming the reflector, not illustrated.

The upper catenaries, including catenary line 29 extend from the ring-shaped juncture 30 at a position along the truss's axis in between the the truss's front and rear end to the outer end of an upper deployable spar, such as spar 9. The lower catenaries, which are radially aligned with the upper catenaries, including the lower catenary 31 associated with catenary 29, also extend from that ring-shaped juncture to the outer end of an associated lower deployable spar 11, such as the end of spar 11 to which lower catenary 31 connects. It is appreciated that the number of front or rear catenary lines in the truss is equal to the number of bays in the truss.

The connection of each of the catenary lines to an end of an associated one of the deployable spars 9 is made indirectly through a fitting, which the joining member is called. The connection of the line to the fitting may be made with a conventional tensioner, such as a threaded bolt and nut, not illustrated, as in the prior art trusses. A tensioner makes it easier to pull the catenaries somewhat taut and/or tension all catenaries to the same degree. The foregoing embodiment includes a tensioner, not illustrated in the figure, and improvement of the present invention encompasses changes to that tensioner and the associated fitting, which is described hereinafter in greater detail.

Catenary drop ties or, simply, ties, such as 32*a,* of various predetermined lengths join various positions along the individual front catenaries to like positions on the underlying lower catenary to shape the associated catenary into the appropriate curve. Those ties are fastened to the catenary with ordinary knots and are bonded in place with adhesive.

In the illustrated embodiment, four ties equally spaced along the catenary line are fastened between catenary 29 and catenary 31. Consider the three ties in front of tie 32*a,* to be identified as 32*b,* 32*c* and 32*d* in consecutive order, although unlabeled in the figure. The ties increase in length the greater their distance from the center.

The catenaries are either identical tension lines or unequal tension lines depending on the required function of the reflector. In the special case where the catenaries are identical tension lines, each tie pulls the two tension lines toward one another an equal distance, and the shorter the length of the tie, the closer together the opposite catenaries are pulled. The lengths of the individual ties and their location along the respective catenary is selected so that the pair of catenaries each approximate a parabolic curve. Since all of the other catenary and tie arrangements are identical, each catenary forms the same parabolic curve. And overall, as apparent from the figure, the front end of the catenary provides a net surface or skeletal bed that defines a section of a paraboloid.

Figure 3:
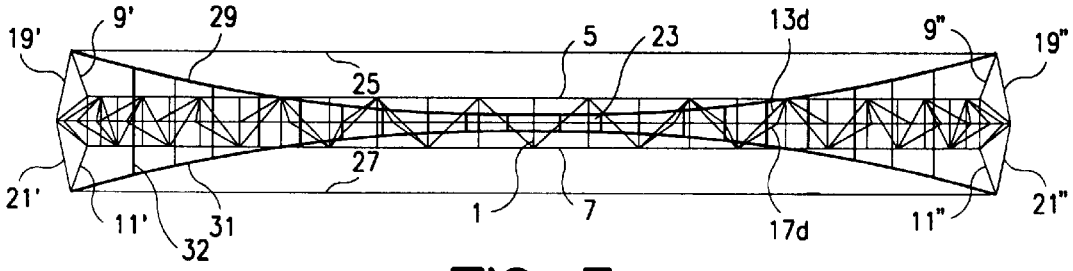
FIG. 3 is a partial diagram of the perimeter truss of FIG. 1, that illustrates a side view of a pair of catenary lines and the drop ties tied there between that shape the lines into the curved shape required, omitting for clarity the intermediate spars and other catenary lines and most of the trusses hoop lines.

The curve is more visible in the side view of FIG. 3 to which brief reference is made. As shown catenary lines 29 and 32 are formed to a parabolic shape by the tie lines 32.

Since the front and rear catenaries are identical in structure and material any physical changes due to temperature change or the like are symmetrically distributed and cannot produce distorting unsymmetrically applied stresses on the remaining truss elements.

Continuing to describe the foundation to the present improvement, reference is made to FIG. 2. Where elements appear in this figure that were earlier identified in FIG. 1, the same denomination is used in this view. And, where multiple numbers of any one element appear, the denomination includes a lower case letter to distinguish one element from the other of the same kind. The framework of the bay sections illustrated includes vertically oriented vertical struts 1, 1*b,* and 1*c,* which are evenly spaced from each other. Each bay in the truss is defined by an adjacent spaced pair of such vertical struts; and each such vertical strut is common to two adjacent bays. In bay 12, hoop longerons 5 and 7 bridge the vertical struts: The upper longeron 5 bridges the upper ends of two adjacent vertical struts 1 and 1*b* in bay 12 in the figure. The lower longeron 7, oriented in parallel with hoop longeron 5, bridges the bottom ends of those same two vertical struts. Together the vertical struts and hoop longerons in a bay define a rectangular or square frame to the bay. Separate pairs of horizontal longerons are included in each of the other bays, such as 5*b* and 7*b* shown for bay 14. The connection between the hoop longerons and vertical struts is a pivotal connection or hinge, as variously termed.

The telescoping diagonal 13 is a telescoping tube arrangement, such as found in a collapsible umbrella, wherein one tube fits within a larger tube and may be slid in or out to respectively adjust the length of the member. The ends of telescoping diagonal 13 are connected to the joint at the upper end of vertical strut 1, and left end of hoop longeron 5, and the lower end of the adjacent vertical strut 1*b* and right end of the lower hoop longeron 7, extending downward diagonally left to right across the formed square frame.

In the adjacent bay 14 to the right in the figure, telescoping diagonal 13*b* extends diagonally upward from left to right, and is connected between the bottom end of vertical strut 1*b* and upper end of vertical strut 1*c*. The connections are also by means of a pivot joint. The next telescoping diagonal, located in the next adjacent bay to the right, is oriented in the same direction as the first described telescoping diagonal 13 located in bay 12. In this truss embodiment, the orientation of the telescoping diagonals in one bay differs from the orientation in each of the adjacent bays by being the mirror image of the other. The telescoping diagonals contain an internal latch, not illustrated, that limits the minimum length of the member.

The two triangular struts 15 and 17 are pivotally joined together at one end to form the apex of a triangle. The remaining end of strut 15 is pivotally connected to the joint at the upper end of vertical strut 1 and the remaining end of triangular strut 17 is pivotally connected to the joint at the lower end of the adjacent vertical strut 1*b*.

The two struts, 15 and 17, form a triangle with telescoping diagonal 13, serving as the triangle's base. Hence, the basis for the denomination of those struts as triangular, which is not a reference to the individual strut's geometry, which is tubular. The left bay 16 contains like triangular struts 15*c* and 17*c*. Bay 14 likewise contains triangular struts 15*b* and 17*b*, which overlie an associated telescoping diagonal 13*b*.

Guy lines, 2 and 4, more particularly referred to as triangular guy lines to distinguish them from other guy lines in the truss, extend from the pivot joint that connects the two triangular struts 15 and 17 respectively to the remaining two corners of the formed square, the two corners, not occupied by an end of either the triangular struts 15 and 17 or telescoping diagonal 13. Thus, triangular guy line 2 extends from the bottom end of vertical strut 1 in the left bay to the apex at the juncture of the triangular struts, and triangular guy line 4 extends from the latter to the upper end of the adjacent vertical strut 1*b*. Corresponding triangular guy lines 2*c* and 4*c* are included in the right bay and 2*b* and 4*b* are included in the center bay. In the center bay, the triangular guy lines extend downwardly from the upper left to the lower right corner of the formed box, as the latter corners are not occupied by the ends of the associated telescoping diagonal 13.

The guy lines are tension members and are inextensible and flexible. As used in this specification, unless otherwise indicated, flexible means pliant, or, as variously termed, generally incapable of retaining any given shape when not subjected to tensile forces, incapable of self-support. Inextensible means that the member does not significantly lengthen or stretch and its length is substantially temperature invariant. An example of such a tension member known to lay persons is a string or cord. In more technical terminology, the guy line is a high modulus near zero creep low coefficient of expansion material, such as graphite multi-filament cords.

A triangular hoop line 23 extends about the periphery of the truss, located mid-way between the trusses front and rear edges, and is connected to the apex joint of each formed triangular section. The triangular hoop line is formed of a plurality of individual tension lines connected essentially end to end between each adjacent formed triangle in each bay.

Upper extension or deployable spar 9 and lower deployable spar 11, extending downwardly, are pivotally attached to the respective upper and lower end of an associated vertical strut, 1, such as by a spring loaded pivot joint or hinge, not here illustrated. A like pair of such spars, 9*b* and 11*b*, and 9*c* and 11*c*, are associated with each of the remaining vertical struts defining the right adjacent bay 14, and three deployable spars in total are illustrated in the two bays illustrated. Spars 9*c* and 11*c* also border the next right most adjacent bay, not illustrated, and Spars 9 and 11 also border the next left most adjacent bay, only partially illustrated in the figure.

Guy lines 19, 20, 21 and 22, shown in the left bay 12, members 19*b*, 20*b*, 21*b*, and 22*b* are like guy lines, included in the center bay 14, and members 19*c*, 20*c*, 21*c*, and 22*c* are like guy lines, included in the right bay 16 in the figure. Each of those guy lines is attached at one end to the outer end of a deployable spar, 9, 9*b*, 11 and 11*b*, respectively, as example in the left bay, and to the joint at the apex of the formed triangle, formed by triangular spars 15 and 17.

Consider the upper deployable spar 9*b*, which is common to bays 12 and 14. Guy wire 20 is connected between the outer end of spar 9*b* and the pivot joint at triangular struts 15 and 17 of the left bay. Guy wire 19*b* is connected between the outer end of that same spar and the pivot joint at triangular struts 15*b* and 17*b* of the middle bay. A force at the end of spar 9*b*, applied perpendicular to the plane of the paper, is resisted by guy lines 20 and 19*b* and the two formed triangles to which those guy lines are connected.

Guy wire 22 is connected between the outer end of lower spar 11*b* and the pivot joint at triangular struts 15 and 17 of bay 12. Guy wire 21*b* is connected between the outer end of that same spar and the pivot joint at triangular struts 15*b* and 17*b* of bay 14.

Upper hoop line 25 is formed of a series of short inextensible tensile members arranged end to end about the upper end of the truss joined to the outer ends of the upper deployable spars. For convenience in this description all like members of that line are designated by the number 25. Lower hoop line 27 is also formed of a series of short inextensible tensile members arranged end to end about the lower end of the truss joined to the outer ends of the lower deployable spar. For convenience in this description all like members of that line are designated by the number 27.

In FIG. 2 it is seen that an end of members 9*b*, 20, 19*b* and 25—25 meet at a common junction in the region indicated as D—D, which is accomplished by a fitting 60, referred to as a single member fitting, as only one of those members is rigid. All those members, except spar 9*c*, are tension members, such as guy wires, and are fixed to the fitting. The catenary 29, a tension line, also connects to that fitting.

Figure 4:
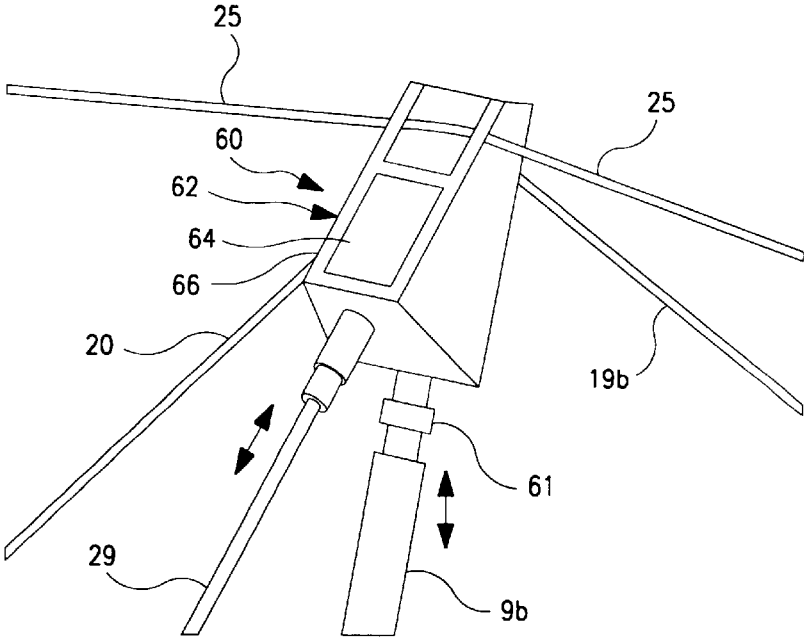
FIG. 4 is a perspective view of the region D—D in FIG. 2, showing, to an even larger scale, the adjusting mechanism forming the improvement to the perimeter truss.

Reference is made to FIG. 4, presenting a perspective view of a small front section D—D of the truss section in FIG. 2 drawn to an enlarged scale. The fitting 60, connected to the end of deployable spar 9*b*, joins together an end of the various structural members of the frame coming together at the end of the spar, including the ends of the two branches of hoop line 25, guy wires 19*b* and 20, and catenary 29, all of which are inextensible tension members. The axes of those elements intersect at the fitting and their ends converge and are attached to the fitting, suitably by crimps or other conventional fastening devices.

Figure 5:
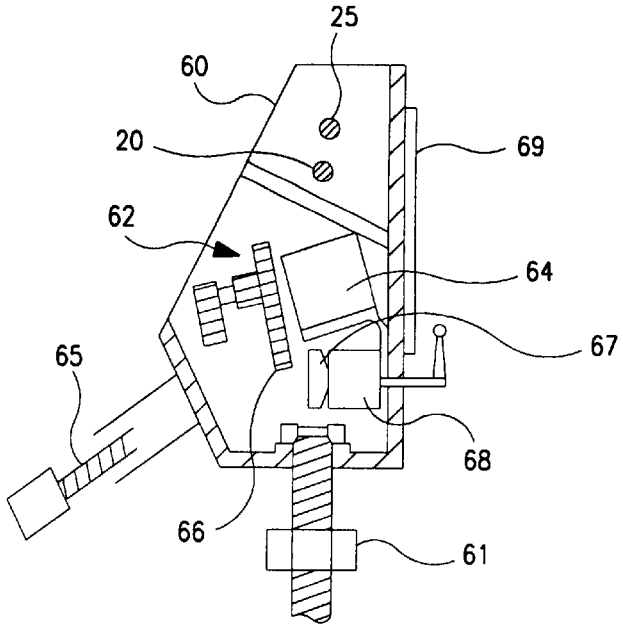
FIG. 5 is a side section view of the adjusting mechanism illustrated in FIG. 4.

Fitting 60 also serves to house a tension adjusting mechanism 62 formed with a micro-miniature stepper motor 64 coupled to and drives a gear train 66, only partially illustrated in this view, and an electronic remote controller 68, later herein more fully described, included for receiving and translating commands and controlling operation of the stepper motor. Those elements are also pictorially illustrated in the side section view of the fitting presented in FIG. 5, which may be reviewed concurrently. As better illustrated in FIG. 5, a rechargable battery 67 serves as a power source and a photocell 69 is attached to the fitting's outer wall.

The end of catenary 29 attaches to fitting 60 by a threaded tensioning member 65 that threads through the wall of the fitting to engage the driven end of gear train 66.

Fitting 60 is mounted to the end of deployable spar 9*b* by an adjustor member 61, consisting of a threaded tubular member, that fits within spar 9*b*, that axially connected to an extension member that joins to fitting 60. Adjustor member 61 is threaded into an internally threaded end in the hollow of the spar. At its other end it attaches to the fitting by a rotatable slip joint.

By turning adjustor member 61 in one direction, the adjustor member moves axially into the spar, essentially shortening the effective length of the spar. Turning the adjustor in the opposite direction moves the adjustor axially out from the spar, essentially lengthening the effective length of the spar, or more precisely, increasing the distance between the fitting and the pivot joint at the other end of the spar. This is a Z-axis adjustment. It permits pre-adjustment of the catenary end necessary to precisely align each catenary with the parabolic surface generated by all catenaries.

The foregoing fitting and associated components is representative of the fittings located at the end of each upper and lower deployable spar in the perimeter truss. Identical fittings and associated components are located at each such position. The Z-axis adjustment is a manual adjustment. It is made on all of the deployable spars with the objective of aligning all catenaries with respect to each other thereby developing a more accurate parabolic surface.

Micro-miniature stepper motor 64 is a DC operated positioning or stepping device. When DC is applied, even momentarily, to its control input, the stepper motor energizes, and rotates or steps its shaft through a predetermined angle, then stops and rechecks the control input for applied DC. Once the motor commences to rotate its shaft, the motor remains energized through a locking circuit to the power supply that by-passes the DC input, ensuring that the motor completes the "step", even though the DC is removed from the DC input. On completion of that step, should the applied DC remain at the DC input, the stepper motor again energizes and proceeds through another step. Otherwise the motor stops and awaits application of another DC voltage to its DC control input.

By applying a series of appropriately spaced DC pulses, the motor shaft rotates through a like number of steps and the distance the shaft travels is precisely known. Because the stepper is of a small size physically, it is readily integrated into the perimeter truss. Its light weight minimizes the impact on launch weight, although being of greater weight relative to perimeter trusses that do not contain this feature or its benefit.

The stepper motor's shaft is coupled to and drives gear train 66. The gear train in turn steps down or reduces the shaft's mechanical movement to a movement at the gear train output that is but a small fraction of the rotation of the driving shaft, thereby increasing torque. As becomes apparent, the amount of physical movement required to change the tension in the catenary is very small. The gear train thus minimizes the torque required of the stepper motor, and, hence, its power consumption to the minimum necessary.

Figure 6:
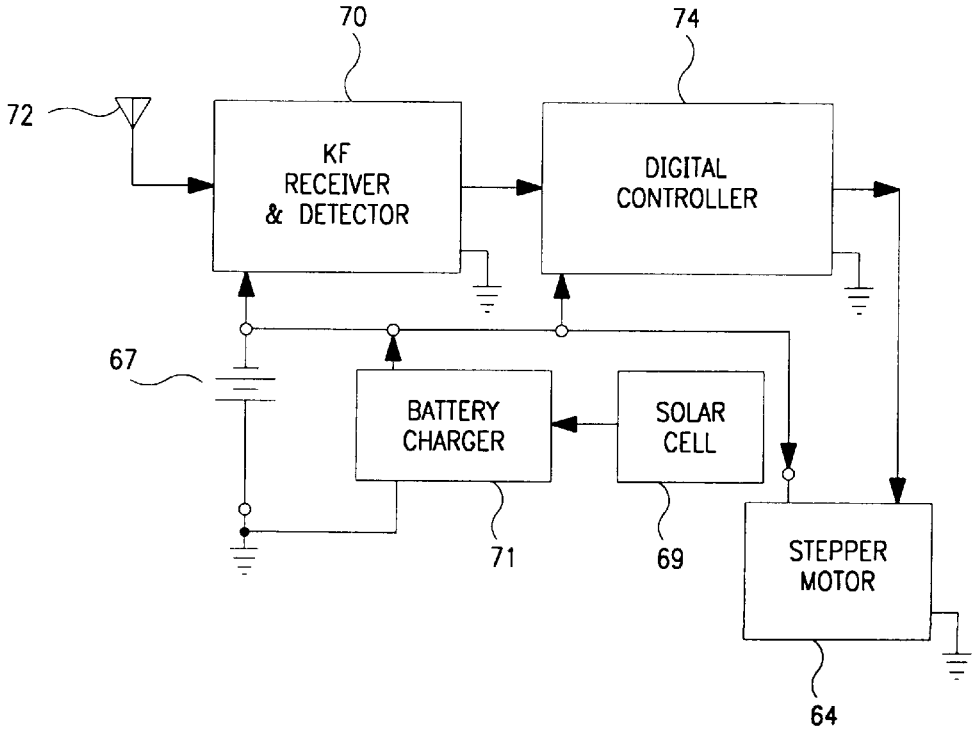
FIG. 6 is a block diagram of the electronics circuit used to control the adjusting mechanism of FIG. 4.

As illustrated in the block diagram of FIG. 6, the electronic remote control circuit includes an RF receiver and detector 70 to receive coded RF received at antenna 72. That coded RF is detected and outputted as digital data to digital controller 74. The digital data may comprise a packet of data that includes a digital address, unique to the digital controller at the one particular location which the controller recognizes as its own, and once recognizes registers the digital data that accompanies the address information. The controller then converts or translates that information into the appropriate number of voltage pulses in order to step the stepper motor a like number of counts or steps. The controller outputs those pulses to the stepper motor 64. Digital controllers of this type are typically microprocessor controlled and contain appropriate memory, buffers, registers and input and output interface devices. The microprocessor operates under control of a stored program, the software.

Each fitting in the perimeter truss is assigned a unique digital address. Thus only the control circuit whose address is included in the data stream sent from the remote transmitting source will decode and implement the command data, also sent in the same data stream or packet. That wireless reception and remote control feature eliminates the need for additional electrical cabling from the box to the associated space vehicle that would otherwise be required as a substitute, a less desirable alternative arrangement.

Rechargeable DC battery 69 supplies power to the stepper motor and the electronic controller. The rechargeable battery is of the smallest available size. It is anticipated that batteries that are of credit card size would be desired for this application. Examples of credit card size batteries currently marketed is the Xerox flat pack battery.

A photoelectric battery charging apparatus 71 for maintaining the battery charger converts the current supplied by photocell 69, located on an outer wall of the housing, where it will be accessible to sunlight. Additionally, electronic control circuit includes a digital radio receiver and control circuit 70 for wireless transmission of commands for the stepper motor via a digital radio communication link.

The battery output is connected to the power input of each of the circuits 70, and 74 and the stepper motor 64. Solar cell 69 is connected to an input of battery charger 71 and the output of that battery charger is connected to the battery. The solar cell converts any available sunlight to DC current, which is coupled to an input of conventional battery charger circuit 71. In turn the latter circuit trickle charges the battery.

To conserve battery current, the RF receiver and the digital controller preferably should contain a "sleep" circuit to consume minimal current during idle condition while awaiting a receipt of a command from the remote source, the detection of an RF signal of the proper frequency and code.

The incremental increase, or decrease, in the tension or stress produced in the catenary by each step of the stepper motor in one respective direction or the other is determined during manufacture and test in a calibration process, best obtained empirically. From the base tension set, the stepper is stepped one step at a time and, each, time the tension in the catenary is measured and its curvature determined. All such steppers in the truss are stepped accordingly and the feed efficiency measured. Thus, if in space, a drop in feed efficiency is detected, the ground operator may initiate a command to step the motor one step. But importantly the stepper system can be used to tension the catenary lines initially at the manufacturer. In prior trusses, the caternary line tension is adjusted by hand, checked and measured. The technician must physically touch the truss. With the foregoing invention, tension adjustment is hands-free.

It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. In a foldable perimeter truss reflector, including a pliant reflective mesh material, and a catenary line system for shaping said pliant reflective material into a curved surface, said catenary line system comprising a plurality of catenary lines, said catenary lines being placed in tension on unfolding of said perimeter truss reflector, the improvement comprising in combination therewith: electric motor driven tension adjustment means for adjusting the tensile force in said catenary lines subsequent to unfolding of said reflector, whereby the share of said curved surface may be changed.

2. The invention as defined in claim 1, further comprising electronic controller means for controlling said electric motor tensioning means.

3. The invention as defined in claim 2, wherein said electronic controller means includes RF receiver means for receiving tensioning command signals from a remote source.

4. The invention as defined in claim 3, further comprising: rechargeable battery means for supplying electrical current to said electronic controller means.

5. The invention as defined in claim 4, further comprising: solar cell means for generating electrical current in response to sunlight; and recharger circuit means coupled to said solar cell means and said rechargeable battery means for providing recharging current to said rechargeable battery means.

6. The invention as defined in claim 1, wherein said electrical motor tensioning means further comprises: a stepper motor.

7. In a foldable perimeter truss reflector, including a pliant reflective mesh material, and a catenary line system for shaping said pliant reflective material into a curved surface, said catenary line system comprising a plurality of catenary lines, wherein said plurality of catenary lines are placed in tension on unfolding of said perimeter truss reflector, and a plurality of fitting means, each of said plurality of fitting means for supporting an end of a respective one of said plurality of catenary lines, the improvement comprising in combination therewith: a plurality of electric motor driven tension adjusting means, each of said electric motor driven tension adjusting means being supported by a respective one of said plurality of fitting means for adjusting tension in the catenary line supported by said respective one of said plurality of fitting means following unfolding of said perimeter truss reflector.

8. The invention as defined in claim 7, wherein said electric motor driven tensioning means comprises: micro miniature stepper motor means.

9. The invention as defined in claim 8, wherein said electric motor driven tensioning means further comprises: driven gear means coupled to said micro miniature stepper motor means and to said catenary line for coupling movement of said stepper motor means to longitudinal movement of said catenary line.

10. The invention as defined in claim 9, further comprising:

RF receiver means for receiving line tension information originating from a remote source;

electronic controller means to control said stepper motor means for receiving line receiving tension information from said receiver means and initiating stepping of said stepper motor means.

11. A foldable perimeter truss reflector, comprising:

a first plurality of horizontal longerons connected together in end to end relationship to form a first closed loop;

a second like plurality of horizontal longerons connected together in end to end relationship to form a second closed loop of like size to said first closed loop;

said first and second closed loops being coaxially and angularly aligned with one another, whereby said longerons of said first plurality of horizontal longerons overlie and are aligned with associated horizontal longerons of said second plurality of horizontal longerons;

a plurality of vertical struts, said plurality being equal in number to said first plurality of horizontal longerons;

each said vertical strut being connected between adjacent ends of two adjacent ones of said horizontal longerons of said first closed loop and an underlying adjacent ends of two adjacent ones of said horizontal longerons of said second closed loop that underlie said two adjacent ones of said horizontal longerons of said first closed loop to define a plurality of rectangular frames positioned in side by side relationship arranged in a cylindrical ring with each said frame including upper left, upper right, lower left and lower right corners;

a first plurality of deployable spars, each said spar in said first plurality being pivotally supported at one end by a respective one of said upper left corners;

spring biased pivot means at each said upper left corner for biasing a respective deployable spar to pivot to a deployed position with a distal end of said associated deployable spar positioned outwardly of the adjacent rectangular frame;

a second plurality of deployable spars, each said spar in said second plurality being pivotally supported at one end by a respective one of said lower left corners; and spring biased pivot means at each said lower left corners for biasing a respective deployable spar to pivot to a deployed position with a distal end of said associated deployable spar positioned outwardly of the adjacent rectangular frame;

a plurality of flexible tension lines, each tension line being connected between the outer ends of an adjacent pair of said first plurality of deployable spars and collectively defining a circular hoop for a front edge to the truss;

a second plurality of flexible tension lines, each tension line being connected between the outer ends of an adjacent pair of said second plurality of deployable spars and collectively defining a second circular hoop for a rear edge to the truss;

a first plurality of catenary lines, said first plurality of catenary lines being supported from said distal ends of said first plurality of deployable spars;

a second plurality of catenary lines, said second plurality of catenary lines being equal in number to said first plurality and said second plurality of catenary lines being supported from said distal ends of said second plurality of deployable spars;

a first plurality of fitting means, each of said fitting means for connecting one end of a catenary line in said first plurality of catenary lines, and an end of a pair of flexible tension lines in said first plurality of flexible tension lines to an outer end of an associated one of said first plurality of deployable spars; and a second plurality of fitting means equal in number to said first plurality of fitting means, each of said fitting means in said second plurality for connecting one end of a catenary line in said second plurality of catenary lines and an end of a pair of flexible tension lines in said second plurality of flexible tension lines to an outer end of an associated one of said second plurality of deployable spars;

each of said deployable spars including: manual adjustment means for axially positioning an associated one of said fitting means; and each of said fitting means further including:

microminiature stepper motor means and gear means for adjusting tension in the catenary line;

electronic controller means for controlling operation of said microelectronic stepper motor means;

RF receiver means for receiving tensioning command information from a remote location and supplying said tensioning command information to said electronic controller means;

a rechargeable battery for supplying electrical power to said electronic controller means, said RF receiver means and said stepper motor means; and a battery charger for supplying recharging current to said rechargeable battery, including a solar cell for converting incident light to electricity.

* * * * *